United States Patent [19]

Consolatore et al.

[11] Patent Number: 4,743,029

[45] Date of Patent: May 10, 1988

[54] DOCKET DIARY GAME

[76] Inventors: Michael Consolatore, 737 7th St., W. Babylon, N.Y. 11704; Jean Cafarella, 429 39th St., Lindenhurst, N.Y. 11757

[21] Appl. No.: 906,265

[22] Filed: Sep. 8, 1986

[51] Int. Cl.[4] ..... A63F 3/00

[52] U.S. Cl. ..... 273/243; 273/287; 273/DIG. 26; 273/281

[58] Field of Search ..... 273/291, 281, 287, 280, 273/248, 249, 243, 256, DIG. 26

[56] References Cited

U.S. PATENT DOCUMENTS

| | | | |
|---|---|---|---|
| 2,409,493 | 10/1946 | Jones | 273/281 |
| 3,367,662 | 2/1968 | Charles et al. | 273/256 |
| 3,815,919 | 6/1974 | Cain et al. | 273/249 |
| 3,858,885 | 1/1975 | Adcock | 273/243 |
| 3,939,578 | 2/1976 | Coffey | 273/243 |
| 4,003,577 | 1/1977 | Bolach | 273/243 |
| 4,109,918 | 8/1978 | Mele et al. | 273/243 |

*Primary Examiner*—Richard C. Pinkham
*Assistant Examiner*—Benjamin Layno
*Attorney, Agent, or Firm*—Richard L. Miller

[57] ABSTRACT

A docket diary game is provided and consists of a board game that allows each player to choose one season out of the year and answer questions based on each day of the months during that season. The first player to correctly answer questions for seven days out of each of three months in his/her season from month cards and answer correctly one question from a pack of docket diary cards wins the game. The game board is provisioned with mechanism to indicate correct answers which can not be inadvertently changed by accidentally jarring the board.

7 Claims, 1 Drawing Sheet

DOCKET DIARY GAME

BACKGROUND OF THE INVENTION

The instant invention relates generally to board games and more specifically it relates to a docket diary game.

Numerous board games have been provided in prior art that are adapted to contain instruction, skill, chance and intrigue. However, most board games are limited in using only one of these types of benefits. While these board games may be suitable for the particular purpose to which they address, they would not be as suitable for the purposes of the present invention as heretofore described.

SUMMARY OF THE INVENTION

A primary object of the present invention is to provide a docket diary game that will overcome the shortcomings of the prior art devices.

Another object is to provide a docket diary game that allows each player to choose one season out of the year and answer questions based on each day of the months during that season.

An additional object is to provide a docket diary game in which the first player to answer correctly questions for seven days out of each of these months in his/her season and answer a question correctly from a docket diary card wins the game.

A further object is to provide a docket diary game that is simple and easy to use.

A still further object is to provide a docket diary game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
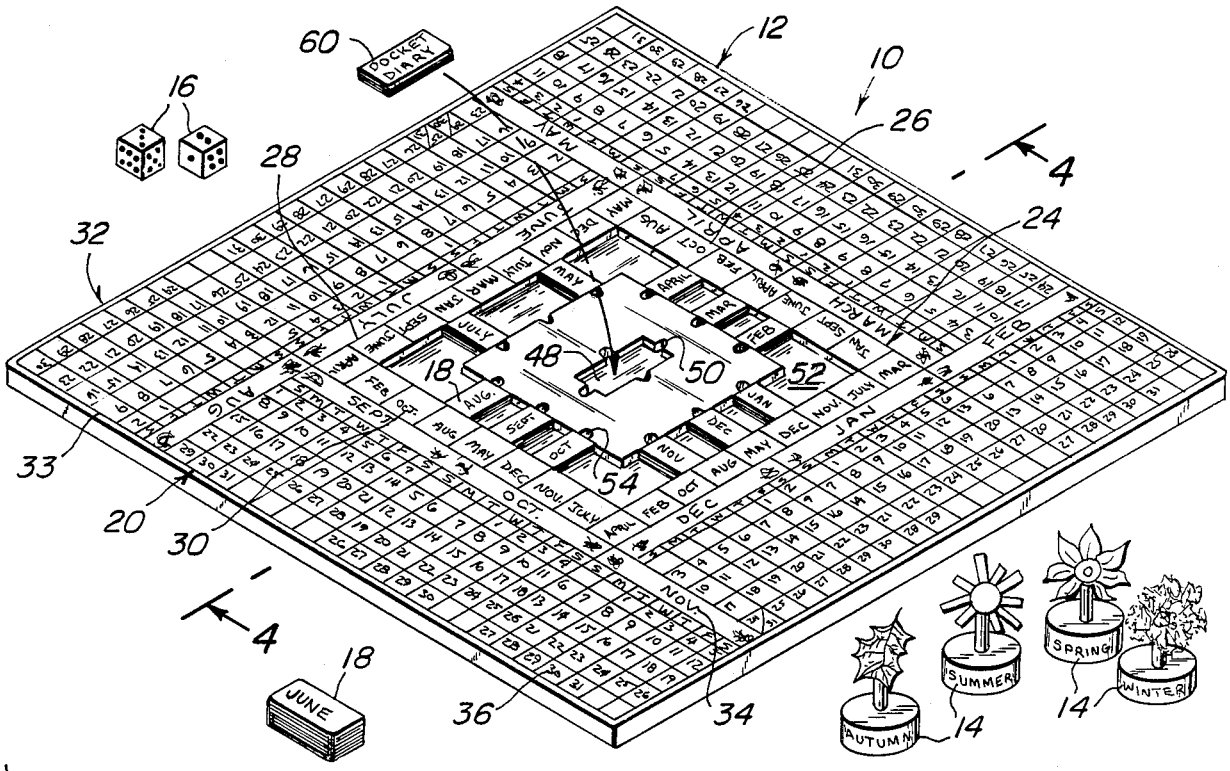
FIG. 1 is a perspective view of the invention.

Turning now descriptively to the drawings, in which similar reference characters denote similar elements throughout the several views, FIGS. 1 through 4 illustrate a docket diary game 10 that consists of a game board 12, a plurality of playing pieces 14, a random number generator 16, thirteen groups of cards 60 and correct answer indicating devices 20.

The game board 12 has an inner zone 24 with a plurality of spaces 26 defining a path of travel 28. Indicia 30 representing months is in random association with respect to each of the spaces 26. The game board 12 also has an outer zone 32 with a twelve month calendar 33. Each month 34 has its proper sequence of days 36 thereof. The playing pieces 14 are for use by participants of the game 10. Each of the playing pieces 14 is of a size to fit on the spaces 26 on the game board 12. The random number generator 16 which is a pair of dice provides numeric designations representing a magnitude of movement for each of the playing pieces 14 along the path of travel 28. Each group of cards 18 is correspondingly identified with each of the months 30 and 34. Each group is correspondingly identified with each of the days 36 of each of the months 34 and has a question and answer thereon. Each card of the docket diary group of cards 60 has a bonus question and answer thereon. The correct answer indicating devices 20 is used for indicating a correct answer for each day of each month in the outer zone 32.

The twelve month calendar 33 is grouped into four seasons beng Winter (December, January and February), Spring (March, April and May) Summer (June, July and August) and Autumn (September, October and November). Each of the playing pieces 14 represents one of each of the seasons. Each of the questions on each of the month cards 18 pertains to an event that happened on that date and each of the answers is in multiple choice form. Each of the questions on each of the docket diary cards 60 can be from any of the months 34 and each of the answers is not in multiple choice form.

Figure 2:
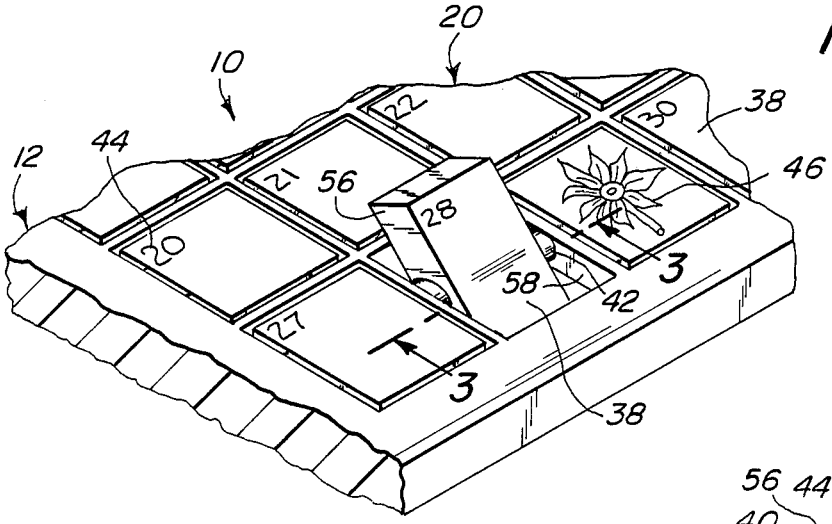
FIG. 2 is a enlarged perspective view of an edge portion of the game board.
Figure 3:
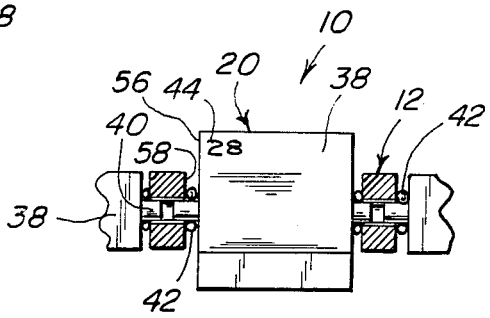
FIG. 3 is a cross sectional view taken along line 3—3 in FIG. 2 showing the O-rings and movable tiles therebetween.
Figure 4:
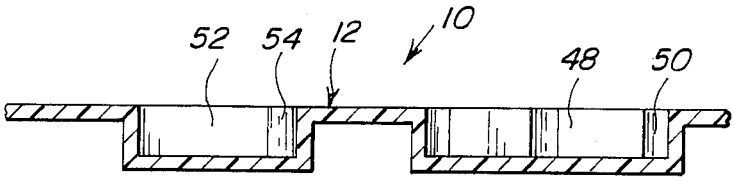
FIG. 4 is a partial cross sectional view taken on line 4—4 of FIG. 1.

As best seen in FIGS. 2 and 3, the indicating devices 20 include a plurality of tiles 38, shafts 40 and O-rings 42. Each of the tiles 38 have a number 44 representing a date on one side and a symbol 46 representing a season on other side. Each of the shafts 40 extend through ends of each of the tiles 38. Each of the O-rings 42 is placed on each end of each of the shafts 40 before the shafts go into the game board 12. Each of the tiles 38 can be rotated to a stationary position from its date to its season and vice-versa.

In operative use during the playing of the game some of the tiles 38 need be rotated about shaft 40 from one position to another (depending upon the rules of the particular game being played). It is important that the tile 38 does not inadvertently change its position accidentally during play, due to the jarring of the board or an imbalance in an individual tile when manufactured. The purpose of the O-rings 42 is that because the O-rings are slightly compressed between the tile edge surface 56, and the vertical surface 58 of the board 12 the tiles require a certain minimal force to rotate them about shaft 42. This force must over come frictional forces produced at the surfaces of the O-rings in contact with the board vertical surface 58, and the tile edge surface 56, and thus the tile can not rotate by it self.

The docket diary game 10 further contains a first recess 48 centrally positioned on the game board 12 providing storage room for the docket diary cards 60 before being used. The first recess 48 has tapered side grooves 50 permitting insertion of the participants fingers into the first recess 48 to remove the docket diary cards 60 during play of the game 10. A second recess 52 on the game board 12 extends around the first recess 48 to provide storage room for the twelve groups of cards 18 before being used. The second recess 52 has one tapered side groove 54 for each of the groups of cards 18 for permitting insertion of the participants fingers into the second recess 52 to remove the cards 18 during play of the game 10.

TYPICAL RULES OF THE GAME

A player must pick a season at the beginning of the start of the game 10. The season chosen is the season to be completed in order to win the game. A player will pick one season for example: Summer emblem: the sun. The player will take his/her player piece with its season emblem and place it on any one of the month spaces 26 of his/her season on the inner zone 24, anywhere on the game board 12. A player that rolls the highest number on the dice 16 starts the game 10. He/She moves his/her player piece around the inner zone 24 the number he/she rolled. If he/she does not land on a month in his season (Summer), he/she passes his/her turn to the player on the right. If he/she landed on a month in his/her season (June, July, or August) the player then will have to answer a question from that stack of cards 18. For example: The player piece 14 lands on June, the player to the left will read the player a June question card. If the player guesses the answer wrong he/she loses a turn. If the player answers correctly, he/she pushes the tile 38 with the corresponding date over that was answered correctly. Once the player has answered seven days out of each month in his season correctly-(A total of 21 days of questions), he/she then qualifies for a docket-diary question card 60. Docket diary cards are bonus cards that have no multiple choice answers. If the question is answered correctly, the player wins the game. Tiles 38 may be turned over to keep track of the progress of players.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A docket diary game which comprises:

(a) a game board having an inner zone with a plurality of spaces defining a path of travel, indicia representing the twelve months being in random association with respect to each of said spaces an outer zone divided into twelve sections, each corresponding to one of the months of a twelve month calendar, each of the respective sections having a plurality of contiguous positions arranged in a group within the corresponding sections, said positions corresponding to the proper sequence of days in the corresponding month;

(b) a plurality of playing pieces for use by participants of said game, each of said playing pieces of a size to fit in said spaces of said game board;

(c) a random number generator providing numeric designations representing a magnitude of movement for each of said playing pieces along said path of travel;

(d) twelve groups of cards, each group respectively identified with a corresponding one of said twelve months, each card within a group respectively identified with a corresponding one of said days within the corresponding month, whereby there is one card for each position, each card having a question and answer thereon;

(e) an additional group of cards identified as a docket diary, each card of said docket diary having a bonus question and answer thereon;

(f) indicating means on each of said positions for indicating a correct answer for its respective card; and (g) means for preventing the accidental change of said correct answer by said indicating means due to jarring of said game board.

2. A docket diary game as recited in claim 1 wherein said twelve sections, each corresponding to one of the months of a twelve month calendar, are grouped into four seasons being Winter, Spring, Summer, and Autumn and each of said playing pieces represents one of said seasons.

3. A docket diary game as recited in claim 2 wherein said random number generator is a pair of dice.

4. A docket diary game as recited in claim 3 wherein each of said questions on each of said cards in said twelve groups of cards pertains to an event that happened on that date and each of said answers being in a multiple choice form with the correct answer being the day and month corresponding to its respective position.

5. A docket diary game as recited in claim 4 wherein each of said questions on each of said docket diary cards is any of said months and each of said answers not being in a multiple choice form.

6. A docket diary game as recited in claim 5 wherein said indicating means includes:

(a) a plurality of tiles, each of said tiles having a number representing a date on one side and a symbol representing a season on the other side; and (b) a plurality of O-rings, each of said O-rings placed between a vertical surface of said tile and a surface of said game board whereby said tile is prevented from accidentally changing its position.

7. A docket diary game as recited in claim 6 further comprising:

(a) a first recess centrally positioned on said game board providing storage room for said docket diary cards before being used, said first recess having tapered side grooves permitting insertion of said participants fingers into said docket diary cards during play of said game; and (b) a second recess on said game board extending around said first recess providing storage room for said twelve groups of cards before being used, said second recess having one tapered side groove for each of said groups of cards permitting insertion of said participants fingers into said second recess to remove said cards during play of said game.

* * * * *